US009654865B2

(12) United States Patent
Zhao et al.

(10) Patent No.: US 9,654,865 B2
(45) Date of Patent: May 16, 2017

(54) EARPHONE

(71) Applicant: GOERTEK INC., Shandong (CN)

(72) Inventors: Yanpeng Zhao, Shandong (CN); Qigao Chen, Shandong (CN); Jiangtao Xu, Shandong (CN)

(73) Assignee: Goertek, Inc., Shandong (CN)

( * ) Notice: Subject to any disclaimer, the term of this patent is extended or adjusted under 35 U.S.C. 154(b) by 0 days.

(21) Appl. No.: 14/914,348

(22) PCT Filed: Aug. 26, 2014

(86) PCT No.: PCT/CN2014/085209

§ 371 (c)(1),
(2) Date: Feb. 25, 2016

(87) PCT Pub. No.: WO2015/027900

PCT Pub. Date: Mar. 5, 2015

(65) Prior Publication Data

US 2016/0219360 A1 Jul. 28, 2016

(30) Foreign Application Priority Data

Aug. 26, 2013 (CN) ..... 2013 1 0376614

(51) Int. Cl.

| | |
|---|---|
| ***H04R 1/10*** | (2006.01) |
| ***H04R 1/28*** | (2006.01) |
| *H04R 1/06* | (2006.01) |

(52) U.S. Cl.

CPC ..... *H04R 1/2823* (2013.01); *H04R 1/1016* (2013.01); *H04R 1/2876* (2013.01); *H04R 1/06* (2013.01); *H04R 1/1075* (2013.01)

(58) Field of Classification Search

CPC .... H04R 1/10; H04R 2205/022; H04R 1/105; H04R 5/0335; H04R 2201/10

(Continued)

(56) References Cited

U.S. PATENT DOCUMENTS 4,646,872 A * 3/1987 Kamon ..... H04R 1/225 381/373
5,949,896 A * 9/1999 Nageno ..... H04R 1/1016 381/380

(Continued)

FOREIGN PATENT DOCUMENTS

CN 102196329 A 9/2011
CN 203039854 U 7/2013

(Continued)

*Primary Examiner* — Suhan Ni
(74) *Attorney, Agent, or Firm* — Holzer Patel Drennan

(57) ABSTRACT

Disclosed is an earphone comprising a loudspeaker unit, an audio signal wire electrically connected to the loudspeaker unit, and an auxiliary structure; the auxiliary structure comprises a front cover and a housing; a front acoustic cavity is defined as a space between the front cover and the loudspeaker unit, and a rear acoustic cavity is defined as a space between the housing and the loudspeaker unit; an acoustic guide channel capable of enhancing low-frequency performance of the earphone is disposed on one side of an inner sidewall of the housing closer to the loudspeaker unit; the acoustic guide channel comprises an open end and a closed end, and a bottom wall of the acoustic guide channel is provided with a plurality of through holes at a position closer to the closed end. An earphone with this structure improves low-frequency and middle-frequency sound effects of products, and makes the earphone have a good appearance.

11 Claims, 9 Drawing Sheets

(58) Field of Classification Search
USPC ..... 381/370–374, 382
See application file for complete search history.

(56) References Cited

U.S. PATENT DOCUMENTS

| | | | | |
|---|---|---|---|---|
| 6,668,064 | B1 * | 12/2003 | Lin | H04R 1/1016 381/373 |
| 8,055,007 | B2 * | 11/2011 | Kim | H04R 1/1041 381/372 |
| 8,139,806 | B2 * | 3/2012 | Hosaka | H04R 1/1075 381/370 |
| 8,467,561 | B2 * | 6/2013 | Tung | H04R 1/1041 381/373 |
| 8,515,116 | B2 * | 8/2013 | Lee | H04R 1/1041 381/373 |
| 8,879,768 | B2 * | 11/2014 | Podoloff | H04R 1/1016 381/370 |
| 8,989,425 | B2 * | 3/2015 | Hua | H04R 1/2803 381/370 |

FOREIGN PATENT DOCUMENTS

| | | | |
|---|---|---|---|
| CN | 103475968 | A | 12/2013 |
| CN | 203590402 | U | 5/2014 |
| JP | 2009260555 | A | 11/2009 |

* cited by examiner

EARPHONE

CROSS-REFERENCE TO RELATED APPLICATIONS

The present application claims benefit of priority to Chinese Patent Application No. 201310376614.5, entitled "EARPHONE" and filed on 26 Aug. 2013, which is specifically incorporated by reference herein for all that it discloses or teaches. The present application is further a National Stage entry from International Patent Application No. PCT/CN2014/085209, entitled "EARPHONE" and filed on 26 Aug. 2014, which is also specifically incorporated by reference herein for all that it discloses or teaches.

TECHNICAL FIELD

The present invention relates to an earphone, and more particularly, to a hi-fi (high fidelity) earphone for portable electronic communication equipment.

BACKGROUND

As widespread use of portable electronic products such as high quality smartphones, Pads and the like, requirements on earphones capable of cooperating with the electronic products are increasingly higher; the earphones are required to have a small size and hi-fi sound quality performances capable of realistically representing various sound effects, and thus hi-fi earphones become the market trend. Earphones are divided into in-ear, on-ear and semi in-ear earphones based on wearing styles. As the in-ear earphones having poorer wearing comfortableness, and causing potential security risks due to insufficient perception to background sounds when used, as well as considerations of hearing protection, the on-ear and semi in-ear earphones are increasingly preferred by consumers.

Due to sound leakage naturally occurred between the earphone and ear canal when the earphone is worn, the low-frequency performance of the on-ear/semi in-ear earphones is usually insufficient. It is a frequently-used solution that the size of an extension tube for accommodating the audio signal wire is enlarged, and openings for communicating with outside are provided at earphone stem, such that the extension tube of the audio signal wire becomes a acoustic guide channel capable of enhancing low-frequency effects simultaneously; or a acoustic guide channel structure for connecting the rear acoustic cavity with outside is added in the same direction as the extension tube of the audio signal wire. Such structures of acoustic guide channels for enhancing low-frequency effect will increase the size of the earphone, and affect appearance thereof. Moreover, the audio signal wire is fixed in the rear acoustic cavity through wire-knot generally, thus the wire knots will block the acoustic guide channels to varying degrees, and affect the effect of the acoustic guide channels with the above structures.

Furthermore, as on-ear and semi in-ear earphone usually utilize a loudspeaker unit with a diameter more than 13 mm, the volume of the rear acoustic cavity of the earphone is usually relatively larger based on the requirement of appearance design, such that the middle-frequency performance of the earphone is not satisfactory. The volume of the rear acoustic cavity is diminished by adding injection parts in the rear acoustic cavity, such that the cost is relatively higher.

Consequently, it is necessary to improve the earphones with the above structures to overcome the drawbacks in the design technique for the existing earphones.

SUMMARY OF THE INVENTION

In view of the above problems, one objective of the present invention is to provide an earphone capable of ensuring favorable appearance of the earphone and enhancing the low-frequency and middle-frequency sound effects of the earphone.

In view of the above problems, the present invention provides an earphone comprising a loudspeaker unit, an audio signal wire electrically connected to the loudspeaker unit, and an auxiliary structure for accommodating and fixing the loudspeaker unit and the audio signal wire; the auxiliary structure comprises a front cover and a housing, wherein a front acoustic cavity is defined as a space between the front cover and the loudspeaker unit, and a rear acoustic cavity is defined as a space between the housing and the loudspeaker unit; wherein, a acoustic guide channel capable of enhancing low-frequency performance of the earphone is disposed on one side of an inner sidewall of the housing closer to the loudspeaker unit, and the acoustic guide channel extends linearly; the acoustic guide channel has an opening at one end and comprises an open end and a closed end, wherein the open end is in communication with the rear acoustic cavity, and the bottom wall of the acoustic guide channel is provided with a plurality of through holes at a position closer to the closed end, wherein the through holes are in communication with a sidewall of the housing, and an airflow in the acoustic guide channel is in communication with the outside by means of the through holes.

In addition, it is preferred that the housing comprises an accommodating part for accommodating the loudspeaker unit, and a tubular extending part integrally extending from one end of the accommodating part; the rear acoustic cavity is defined as a space between the accommodating part and the speaker unit, and the acoustic guide channel is provided in the accommodating part; the audio signal wire is accommodated in the extending part.

In addition, it is preferred that the acoustic guide channel is composed of a acoustic guide groove and a cover coupled with the acoustic guide groove, the acoustic guide groove comprises two sidewalls extending in a same direction and a blocking wall positioned at the ends of the two sidewalls, the cover is coupled to one side of the acoustic guide groove away from the sidewall of the housing, and the through holes are provided at the bottom wall of the acoustic guide groove closer to the blocking wall.

In addition, it is preferred that the acoustic guide groove is integrally formed with the housing through injection molding, and is provided on the inner sidewall of the housing.

In addition, it is preferred that the cover is made of metal or plastic, and the cover is fixedly coupled with an open end of the acoustic guide groove by gumming or ultrasonic welding.

In addition, it is preferred that the acoustic guide channel comprises a groove-shaped acoustic guide groove formed independently, wherein one end of the acoustic guide groove closer to the inner sidewall of the housing is an open end, and the acoustic guide groove is fixedly coupled with the inner sidewall of the housing to define the acoustic guide channel.

In addition, it is preferred that the inner sidewall of the housing is provided with a concave mounting groove corresponding to the acoustic guide groove, and the mounting groove extends in a shape that is in accordance with a shape of the acoustic guide groove extends.

In addition, it is preferred that a damping sheet for covering the through holes is provided on the through holes; the damping sheet is combined to the bottom wall of the acoustic guide groove, and the damping sheet is made of mesh cloth, sponge or nonwoven fabric.

In addition, it is preferred that the acoustic guide channel has a linear, zigzag or curved shape.

In addition, it is preferred that a portion of the bottom wall of the acoustic guide groove which is combined with the damping sheet has a thickness less than that of other portion of the bottom wall of the acoustic guide groove.

In addition, it is preferred that the housing is provided with a toning hole for communicating the rear acoustic cavity with the outside, wherein the position of the toning hole does not overlap with the position of the acoustic guide channel, and a toning sheet for covering the toning hole is provided on the toning hole; the toning sheet is combined to the inner wall of the housing, and the toning sheet is made of mesh cloth, sponge or nonwoven fabric.

In addition, it is preferred that the length of the acoustic guide channel ranges from 1 mm to 100 mm, the inner diameter of the acoustic guide channel ranges from 0.1 mm to 10 mm.

After employing the above technical solution, compared to the conventional solution, a acoustic guide channel for communicating the rear acoustic cavity with the outside is provided in the earphone of the present invention, and thus improving the low-frequency sound effect of the earphone. Also, the volume of the rear acoustic cavity is reduced as the acoustic guide channel is provided in the rear acoustic cavity, thereby improving the middle-frequency sound effect of the earphone. The added acoustic guide channel of the present invention does not occupy any space in the earphone stem, thereby enabling relatively smaller overall dimension of the earphone stem and ensuring better appearance of the product.

BRIEF DESCRIPTION OF THE DRAWINGS

The above features and technical advantages of the present invention will become more clear and easy to understand through the descriptions of the present invention in connection with the accompanying drawings below.

DETAILED DESCRIPTION

Hereinafter, the present invention will be described in details in connection with the accompanying drawings and particular embodiments.

In the following description, only some exemplary embodiments of the present invention will be described by illustration. There is no doubt that various manners can be utilized to modify the embodiments without departing from the spirit and scope of the present invention, as can be realized by those skilled in the art. Consequently, the accompanying drawings and the description are illustrative in essence, but not intended to limit the scope of the claims. Besides, in the present description, the same reference numbers refer to the same parts.

Embodiment 1

Figure 1:
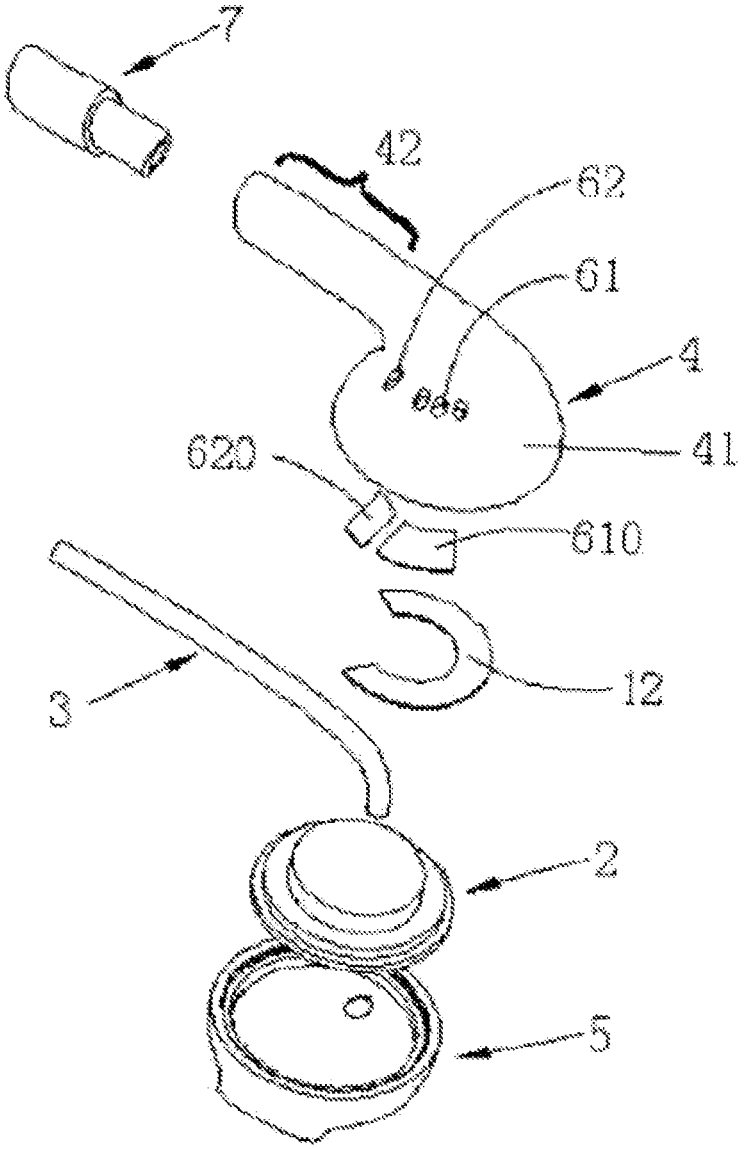
FIG. 1 is a three-dimensional structure exploded view of the earphone according to embodiment 1 of the present invention.
Figure 2:
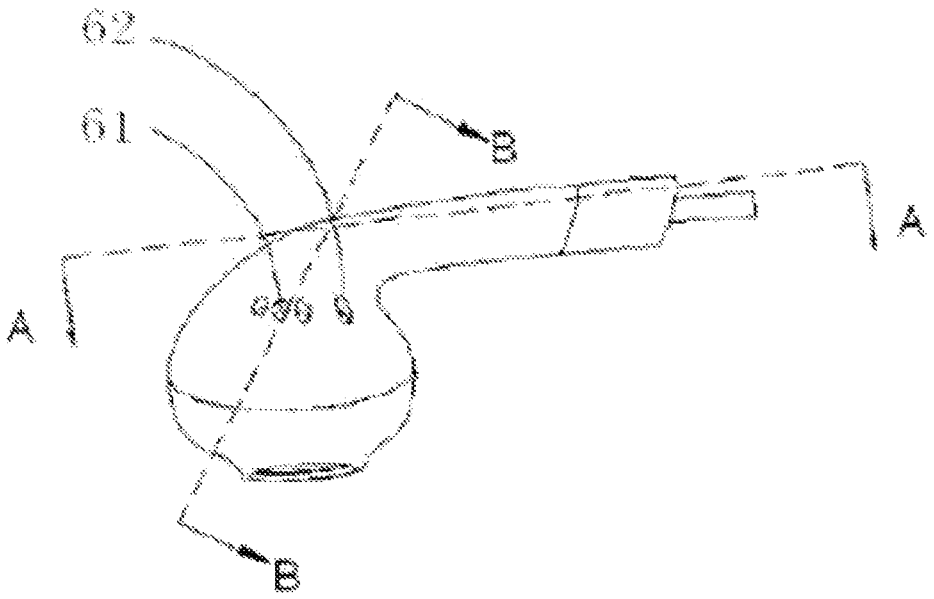
FIG. 2 is a three-dimensional structure view of the earphone according to embodiment 1 of the present invention.
Figure 5:
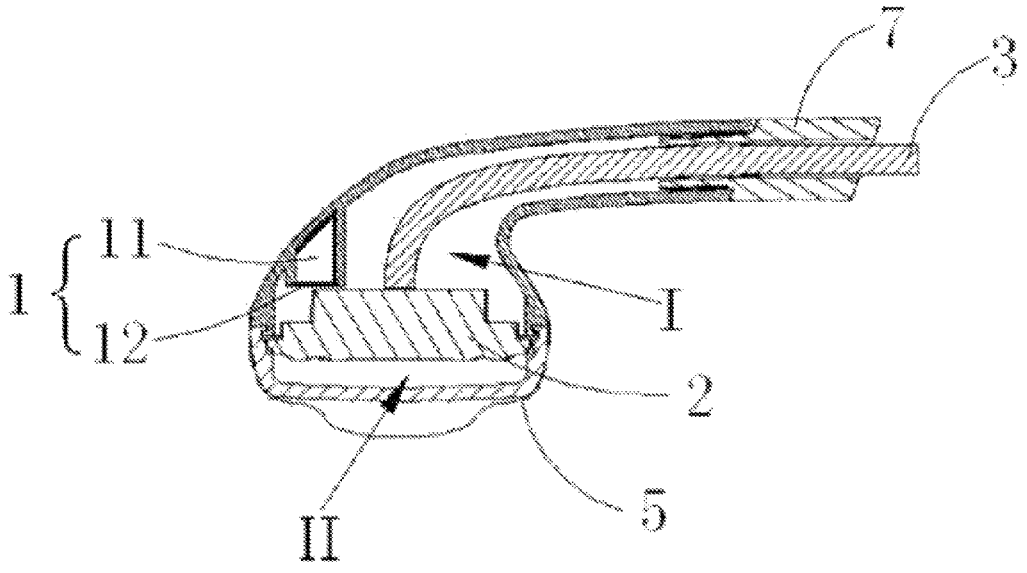
FIG. 5 is a sectional view taken along the A-A line of the structure shown in FIG. 2.
Figure 6:
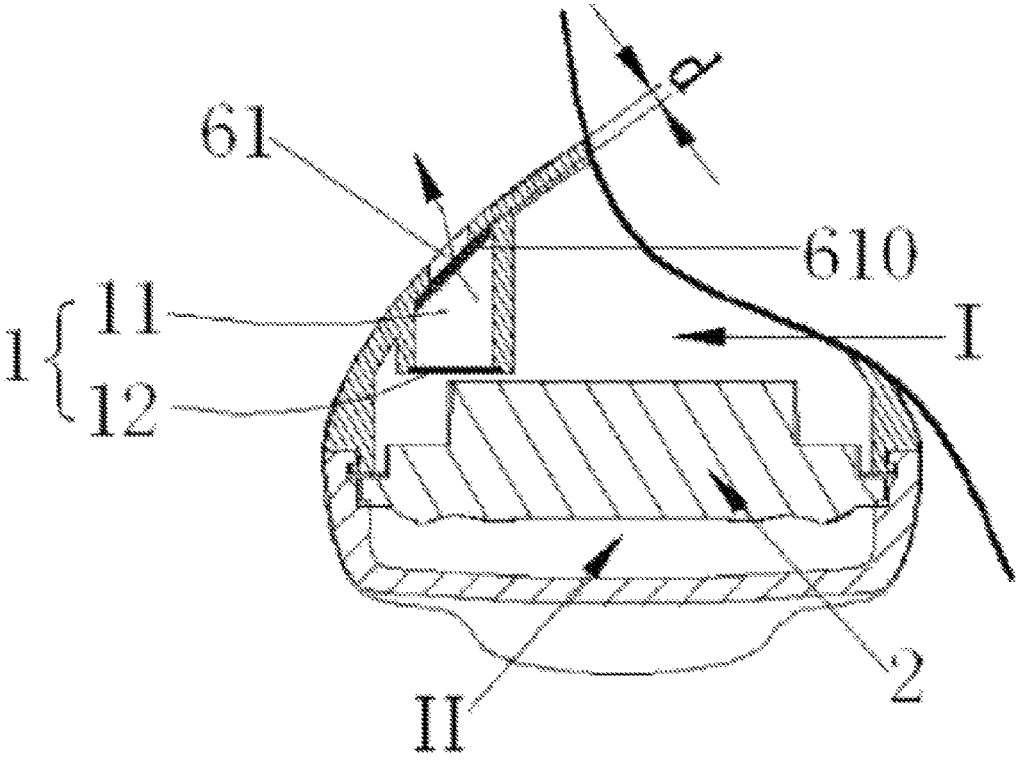
FIG. 6 is a sectional view taken along the B-B line of the structure shown in FIG. 2.

As jointly shown in FIG. 1, FIG. 5 and FIG. 6, the earphone provided by the present invention comprises a loudspeaker unit 2, an audio signal wire 3 electrically connected to the loudspeaker unit 2, and an auxiliary structure for accommodating and fixing the loudspeaker unit 2 and the audio signal wire 3, wherein the auxiliary structure comprises a front cover 5 and a housing 4. Wherein, the loudspeaker unit 2 comprises a vibrating system and a magnetic circuit system (not shown), the vibrating system comprises a vibrating diaphragm; the front cover 5 is provided at a position directly facing the vibrating diaphragm of the loudspeaker unit 2, and a front acoustic cavity II is formed between the front cover 5 and the loudspeaker unit 2, and the front acoustic cavity II is in communication with a sound hole provided at the front cover 5, such that sounds generated by the loudspeaker unit 2 can be transmitted to the outside. The housing 4 is located at one side of the vibrating diaphragm away from the front cover 5, and the rear acoustic cavity I is formed between the loudspeaker unit 2 and the housing 4. The loudspeaker unit 2 further comprises a casing unit for accommodating and fixing the vibrating system and the magnetic circuit system, and openings are provided at the casing unit such that the airflow behind the vibrating diaphragm can be communicated with the rear acoustic cavity I through the openings.

The earphone provided by the present invention further comprises a acoustic guide channel 1, as shown in FIG. 3 to FIG. 6, the acoustic guide channel 1 of the present embodiment has a curved extending shape with an opening at one end, and the acoustic guide channel 1 comprises one open end and one closed end, wherein the open end is in communication with the rear acoustic cavity I, the closed end closes another end of the acoustic guide channel 1 through one blocking wall 111. In addition, the sidewall of the housing 4 is provided with a plurality of through holes 61 at a position corresponding to the position of the closed end, as shown in FIG. 1 to FIG. 6, such that the through holes 61 can communicate the airflow inside the acoustic guide channel 1 with the outside.

As described above, one end of the acoustic guide channel 1 is in communication with the rear acoustic cavity I, and another end of the acoustic guide channel 1 is in communication with the outside by means of the through holes 61. As the acoustic guide channel 1 can provide improved sound quality compared to the loudspeaker unit itself, the structure, by which airflow in the rear acoustic cavity I is in communication with the outside through the tubular acoustic guide channel 1, can generate resonance with the acoustic compliance of the loudspeaker unit, and since the resonance point is lower than f0 of the loudspeaker unit, the structure of the acoustic guide channel 1 provided in such manner is effective to improve the low-frequency performance of the earphone.

Figure 3:
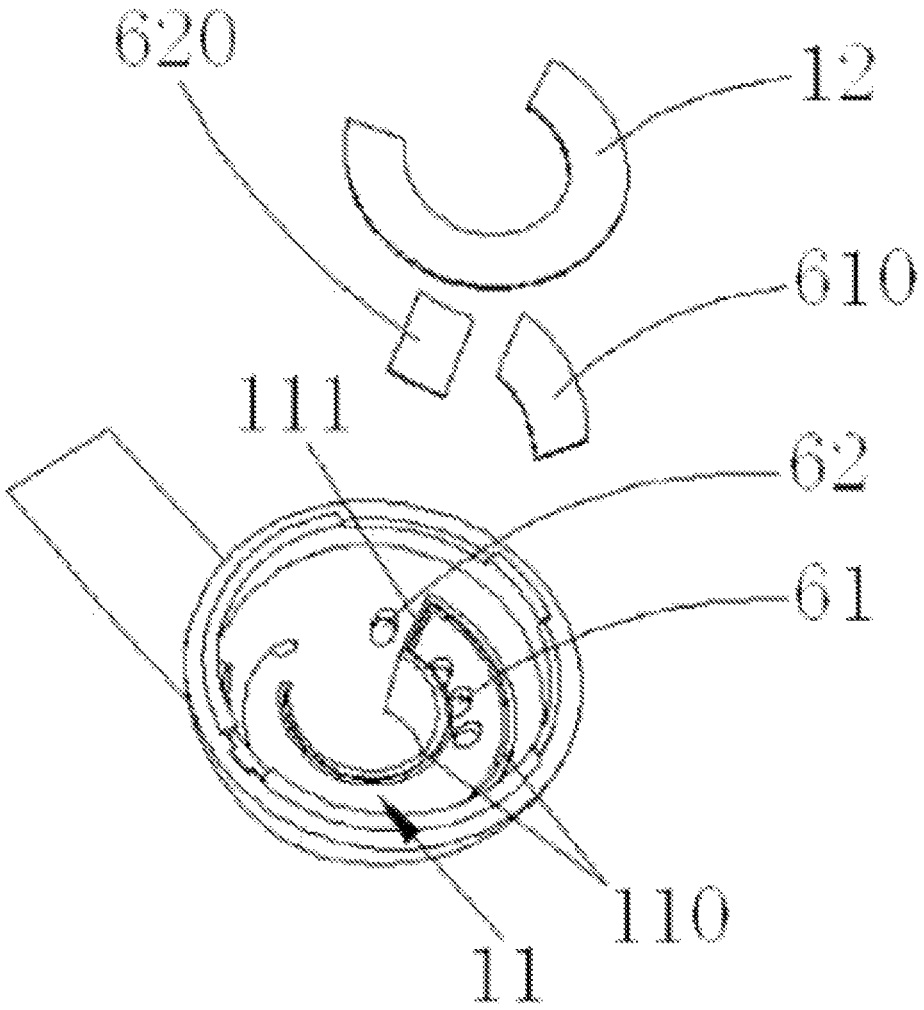
FIG. 3 is a three-dimensional structure view of the housing components of the earphone according to embodiment 1 of the present invention.
Figure 4:
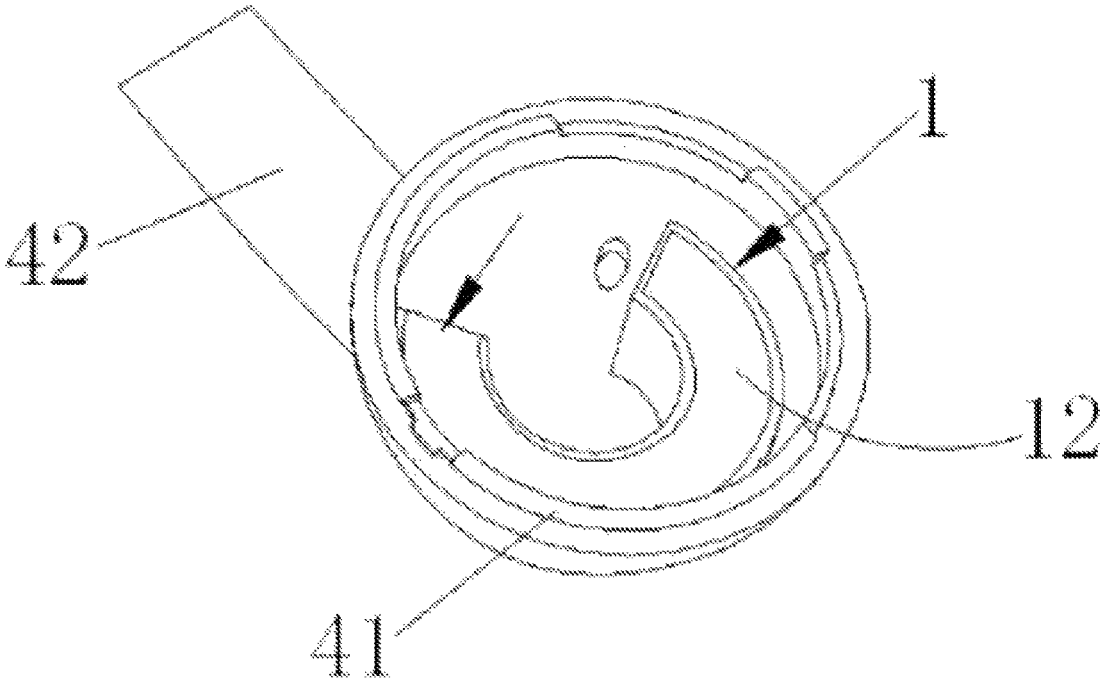
FIG. 4 is a structure view of the housing and the acoustic guide channel of the earphone according to embodiment 1 of the present invention.

The housing component of the earphone provided by embodiment 1 comprises a housing, a toning sheet, a damping sheet and a cover. As shown in FIG. 3 to FIG. 5, the acoustic guide channel 1 is composed of a acoustic guide groove 11 and a cover 12 coupled to the acoustic guide groove 11. The side of the acoustic guide groove 11 closer to the loudspeaker unit 2 is an open end. The acoustic guide groove 11 comprises two sidewalls 110 which are provided on the inner sidewall of the housing 4, and a blocking wall 111 positioned at the ends of the two sidewalls 110 (position corresponding to the closed end of the acoustic guide channel 1), wherein the two sidewalls 110 extend along a curved shape in a same direction, and the two sidewalls 110 are spaced apart from each other by a certain spacing.

The through holes 61 are positioned at the bottom wall of the acoustic guide groove 110 of the acoustic guide channel 1, as shown in FIG. 3 and FIG. 5, that is to say, the airflow in the rear acoustic cavity I can be communicated with the outside by means of the through holes 61 after entering the acoustic guide channel 1. A cover 12 is further coupled to the end surface of the open end of the acoustic guide groove 11, and the cover 12 is fixedly coupled with the acoustic guide groove 11 to define a tubular acoustic guide channel 1. Wherein, the cover 12 can be made of metallic material or plastic material. If the cover 12 is made of metallic material, the cover 12 can be fixedly coupled with the acoustic guide groove 11 by bonding; if the cover 12 is made of plastic material, the cover 12 can be fixedly coupled with the acoustic guide groove 11 by bonding or ultrasonic welding.

Preferably, the acoustic guide groove 11 is integrally formed with the housing through injection molding, that is to say, the acoustic guide groove 11 is provided on the inner sidewall of the housing 4, which can be achieved by a simple forming process. The structure, in which the acoustic guide channel 1 is formed by fixedly combining the acoustic guide groove 11 with the cover 12 according to the present embodiment, can ensure the spatial size inside the acoustic guide groove 11, thereby ensuring the internal size of the acoustic guide channel 1 and facilitating to improve the precision for fabricating products.

Preferably, the acoustic guide channel 1 has a length ranging from 1 mm to 100 mm, and an inner diameter ranging from 0.1 mm to 10 mm. In the above ranges, as the ratio of the sound quality (in direct proportion to the length, and in inverse proportion to the square of the diameter/inner diameter) to the acoustic resistance (in direct proportion to the length, and in inverse proportion to the fourth power of the diameter/inner diameter) of the acoustic guide channel 1 is large enough, it is possible that the acoustic impedance of the acoustic guide channel 1 is dominated by the sound quality of the acoustic guide channel 1 in a low enough low-frequency frequency band, thus generating the best low-frequency sound effect. Wherein, the length of the acoustic guide channel 1 is the equivalent length of the acoustic guide channel 1, that is, the length of the center line of the acoustic guide channel 1; and the inner diameter of the acoustic guide channel 1 is the equivalent inner diameter of the acoustic guide channel 1, that is, after making the acoustic guide channel 1 equivalent to a round tubular structure (with the same cross-sectional area), the diameter inside the tubular structure.

As shown in FIG. 3, FIG. 5 and FIG. 6, a damping sheet 610 for covering the through holes 61 are further provided on the through holes 61. Preferably, the damping sheet 610 is made of acoustic resistance material such as mesh cloth, sponge, nonwoven fabric or the like. The damping sheet 610 is bonded to the inner sidewall of the housing 4 to prevent dust. In addition, as such materials have lower acoustic impedance, they can minimize the damage to the low-frequency performance of the acoustic guide channel 1 caused by the acoustic impedance of the damping sheet 610. In addition, in order to ensure the spatial size inside the acoustic guide channel 1, a portion of the bottom wall of the acoustic guide channel 1 which is bonded with the damping sheet 610 is formed to have a thickness d less than a thickness of other portion of the acoustic guide channel 1, as shown in FIG. 5, the structure, in which a portion of the bottom wall is thinned and then the damping sheet 610 is bonded thereto, will not reduce the inner space of the acoustic guide channel 1, thereby effectively improving the low-frequency performance of the products.

In addition, in the embodiment 1, a toning hole 62 for communicating the rear acoustic cavity I and the outside is further provided at the position corresponding to the rear acoustic cavity I, as shown in FIG. 1 to FIG. 5. The toning hole 62 can be used for tuning the acoustic performance of the earphone, and the toning hole 62 is located in the rear acoustic cavity I and does not overlap with the position of the acoustic guide channel 1, such that airflow in the rear acoustic cavity I can be in communication with the outside directly. A toning sheet 620 capable of covering the toning hole 62 is provided on the toning hole 62 as well, and the toning sheet 620 is combined to the inner sidewall of the housing 4. Preferably, the toning sheet 620 is made of acoustic resistance material with lower acoustic impedance, such as sponge, nonwoven fabric or the like, wherein the parameters of the acoustic resistance material are required to match with the impedances of the acoustic guide channel 1 and the rear acoustic cavity I to modulate the middle-frequency acoustic performance of the earphone.

As jointly shown in FIG. 1, FIG. 4, FIG. 5 and FIG. 6, the housing 4 comprises an accommodating part 41 for accommodating loudspeaker unit 2, and an elongated extending part 42 integrally extending from one end of the accommodating part 41, wherein, the acoustic guide channel 1 is provided in the accommodating part 41, and the audio signal wire 3 is accommodated in the extending part 42. The rear acoustic cavity I of the embodiment 1 is the space between the accommodating part 41 and the loudspeaker unit 2.

In addition, the housing 4 further comprises a fixing part 7 located at one end of the extending part 42, wherein the fixing part 7 is fixedly coupled with the extending part 42, and the fixing part 7 together with the extending part 42 forms an earphone stem; the audio signal wire 3 extends through the extending part 42 and then through the fixing part 7, and the audio signal wire 3 is fixed by the fixing part 7.

In the embodiment 1, the extending part 42 is only used for accommodating the audio signal wire 3, and does not have a structure such as a bass boost tube for communicating the rear acoustic cavity I with the outside in a conventional structure. Thus, the size of the extending part 42 can be relatively small, and there is no need to provide openings at the extending part 42 or fixing part 7 for communicating with the outside, that is to say, the overall dimension of the earphone stem can be relatively small. Therefore, earphones with such a structure have better appearance. As an example, the inner diameter of extending part 42 of the present embodiment can be approximate to the outer diameter of the audio signal wire to meet the appearance requirements on the product under specific circumstances.

Figure 7:
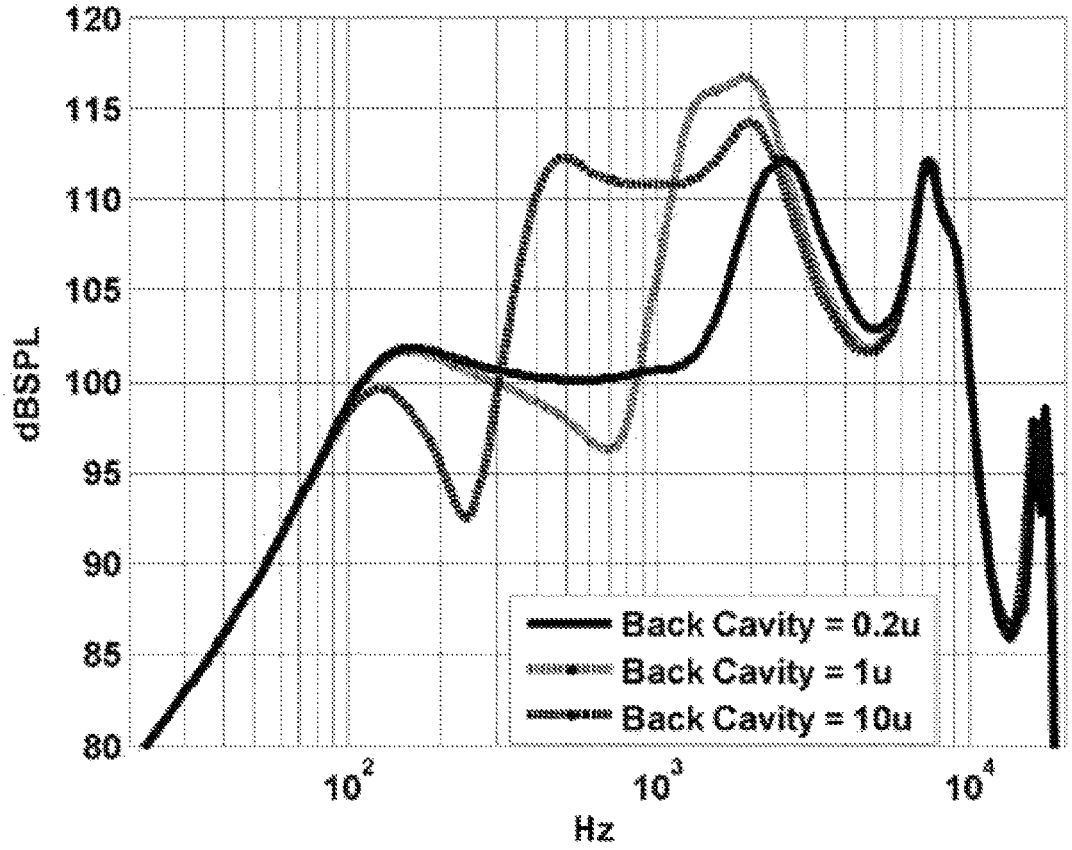
FIG. 7 is graph showing the influence of the size of the volume of the rear acoustic cavity on the middle-frequency acoustic performance of the earphone.

In the embodiment 1, the rear acoustic cavity I only refers to the space inside the accommodating part 41. As shown in FIG. 7, when the rear acoustic cavity I has a relatively larger volume, the middle-frequency peak of the earphone will move towards the low-frequency range, which causes that the sensitivity of the earphone is insufficient in a frequency band near 3 kHz, as this frequency band is the first resonant peak of ear canal, insufficient sensitivity in this frequency band will cause weak subjective listening brightness, thereby deteriorating the tone quality of the earphone. The typical solution is to inject plastic onto the housing 4 so as to fill the space inside the rear acoustic cavity I, but this solution is high in manufacturing cost. In the present invention, since the acoustic guide channel 1 for enhancing bass is located in the accommodating part 41 of the earphone, the acoustic guide channel 1 fill the space inside the rear acoustic cavity I, which is equivalent to reduce the volume of the rear acoustic cavity I of the earphone, such that the middle-frequency peak of the earphone is positioned at a position near 3 kHz, thereby enhancing the tone quality of the earphone, improving the brightness and penetrating power of the earphone, and improving the middle-frequency sound effect of the earphone.

In addition, since the acoustic guide channel 1 and the audio signal wire 3 are accommodated by different structures, the impact caused by the elements, such as wire knots or the like, conventionally adopted in earphone design is avoided, and the interference of the audio signal wire 3 with the acoustic guide channel 1 is avoided, thereby ensuring the stability of the whole earphone.

Embodiment 2

Figure 8:
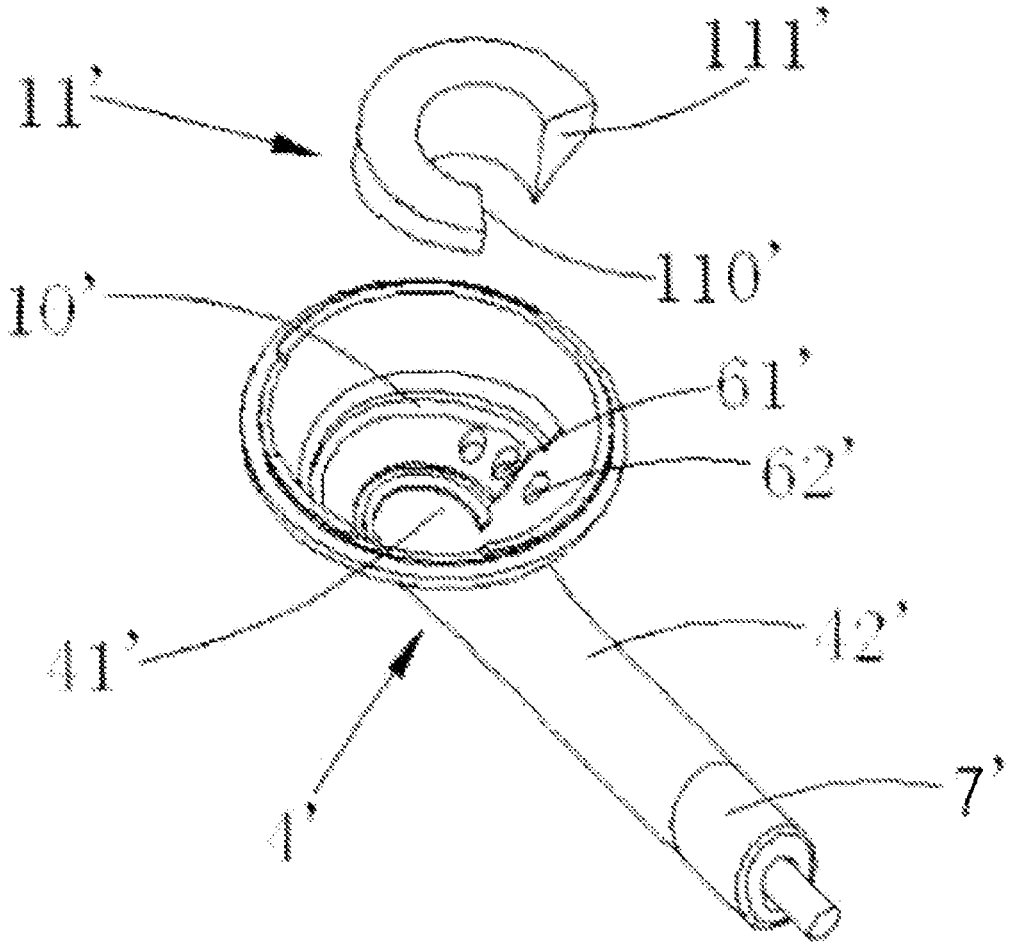
FIG. 8 is a three-dimensional structure exploded view of the housing components of the earphone according to embodiment 2 of the present invention.
Figure 9:
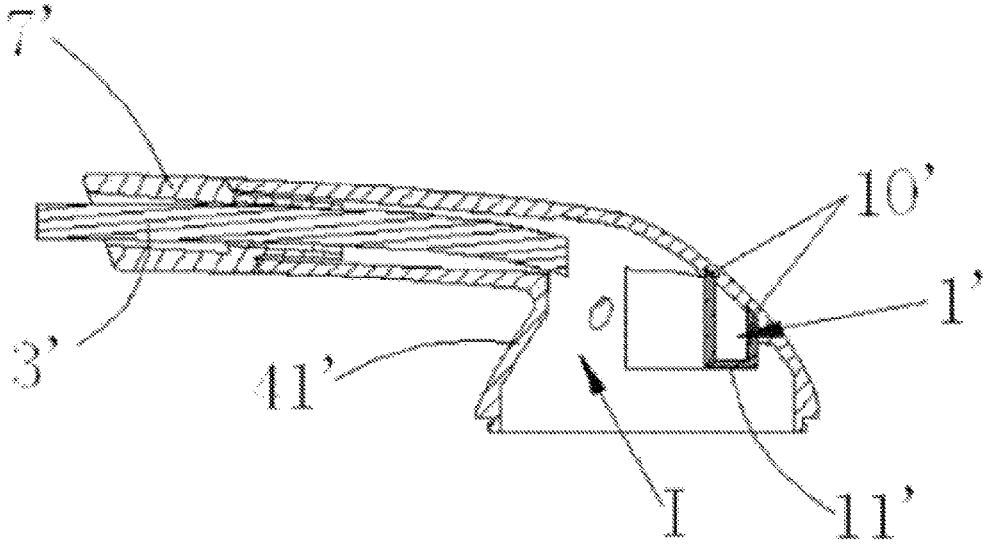
FIG. 9 is a sectional view of the housing components of the earphone according to embodiment 2 of the present invention.

As shown in FIG. 8 and FIG. 9, the main difference between the embodiment 2 and the embodiment 1 is that the components of the acoustic guide channel 1' is different to the acoustic guide channel 1, wherein the acoustic guide channel 1' of the embodiment 2 is a tubular acoustic guide channel 1' with one open end, and the acoustic guide channel 1' is formed by fixing a acoustic guide groove 11' to the inner sidewall of the housing 4'.

Wherein, the acoustic guide groove 11' is an independently formed structure. The acoustic guide groove 11' of the present embodiment 2 comprises two open ends: one open end positioned at one side closer to the sidewall of the housing 4', and another open end positioned at one side communicated with the rear acoustic cavity I'. Similar to the previous embodiment, the housing 4' comprises an accommodating part 41' for accommodating the loudspeaker unit and a tubular extending part 42' extending from the accommodating part, wherein the rear acoustic cavity I only refers to the space surrounded between the accommodating part 41' and the loudspeaker unit. The acoustic guide groove 11' of the present embodiment 2 is independently formed by injection molding, wherein the acoustic guide groove 11' comprises a communicating part 110' for communicating with the rear acoustic cavity I, and a closed end 111'; the sidewall of the housing 4' is provided with through holes 61' at a position closer to the closed end 111', and the through holes 61' can communicate the acoustic guide channel 1' with the outside. On the sidewall of the housing 4', a toning hole 62' is further provided at a position where does not overlap with the position of the acoustic guide channel 1', and the toning hole 62' can be used for modulating acoustic performance of the earphone.

In addition, in the present embodiment, the inner sidewall of the housing 4' is provided with a concave mounting groove 10' at a position corresponding to the bottom open end of the acoustic guide groove 11', and the extending shape of the mounting groove 10' is in accordance with the shape of three sidewalls of the acoustic guide groove 11'. During the assembling process, the acoustic guide groove 11' is arranged to correspond to the mounting groove 10', and then fixedly couple the acoustic guide groove 11' with the mounting groove 10' by gumming. With such provided mounting groove 10', it is possible to ensure firm combination of the acoustic guide groove 11' with the inner sidewall of the housing 4', thereby ensuring the stability of the acoustic guide channel 1'.

After the acoustic guide groove 11' is fixedly coupled with the mounting groove 10', only one end of the acoustic guide groove 11' is open, that is, the communicating part 110' is open. The acoustic guide channel 1' is in communication with the rear acoustic cavity I through the communicating part 110', and then in communication with the outside by means of the through holes 61', thus enabling airflow in the rear acoustic cavity I to communicate with the outside through the acoustic guide channel 1'. The acoustic guide channel 1' can provide improved sound quality compared to the loudspeaker unit itself, and the acoustic guide channel 1' can generate resonance with the acoustic compliance of the loudspeaker unit, since the resonance point is lower than f0 of the loudspeaker unit, the structure of the acoustic guide channel 1' provided in such manner is effective to improve the low-frequency performance of the earphone.

In addition, since the acoustic guide channel 1' is provided in the rear acoustic cavity I, which can improve the middle-frequency characteristics of the earphone. The extending part 42' is only used for accommodating the audio signal wire 3', and not for enhancing the bass effect of the earphone, thereby reducing the overall dimension of the extending part 42', which is conducive to aesthetics of the earphone. The audio signal wire 3' extends through the extending part 42' and then through the fixing part 7', and the audio signal wire 3' is fixed by the fixing part 7'.

In addition, the through-holes 61' and the toning hole 62' can be covered by a damping sheet and a toning sheet to further improve the acoustic performance of the earphone. Preferably, a portion of the bottom wall of the acoustic guide channel 1' which is combined with the toning sheet has a thickness less than that of other portion of the bottom wall without toning sheet, FIG. 8 and FIG. 9 are simple schematic views, wherein the materials such as toning sheet and the difference in thickness of the bottom wall are not shown, as it is easy for those skilled in the art to come up with the improvement on the thickness of the bottom wall on the basis of embodiment 1.

In the embodiment 2, there are other improvements besides the above solution, for example, the acoustic guide channel can be designed as an independently formed tubular structure rather than a groove-shaped structure, and the tubular structure comprises a communicating part communicated with rear acoustic cavity, wherein through holes are provided on the bottom wall at the closed end of the acoustic guide channel, and the acoustic guide channel can be directly formed by injection molding. Such a acoustic guide channel can be directly bonded and fixed to the housing, wherein the through holes in the acoustic guide channel are in communication with the through holes in the housing. In addition, the housing of the earphone can comprise two or more parts, one part of the two or more parts is provided with a acoustic guide channel, and then the one part provided with the acoustic guide channel is coupled with other parts of the housing to form the housing of the earphone.

It should be noted that, other improvements, such as, the shape of the acoustic guide channel is not limited to a curved shape and can be a linear or zigzag shape, can be conducted in the present invention to achieve enhanced bass effect, as long as the acoustic guide channel is in communication with the outside. Preferably, the acoustic guide channel with such a structure can be provided in the rear acoustic cavity to enhance the low-frequency sound effect. Furthermore, the number of the acoustic guide channel is not limited to one, and two or more acoustic guide channels can be used, according to the specific requirements on the acoustic performance of the earphone. In light of the embodiments of the present invention, the above structures can be achieved through simple changes by those skilled in the art, and thus all the above modified solutions fall into the scope of the present invention.

As above, it should be understood by those skilled in the art that as for the earphone structure provided by the present invention above, other improvements and variants, which fall into the scope of the present invention, can be made without departing from the essence of the present invention. It will be understood by those skilled in the art that the above specific description aims at better understanding of the present invention, and the scope of the present invention is limited by the claims and its equivalents.

What is claimed is:

1. An earphone, comprising a loudspeaker unit, an audio signal wire electrically connected to the loudspeaker unit, and an auxiliary structure for accommodating and fixing the loudspeaker unit and the audio signal wire; wherein, the auxiliary structure comprises a front cover and a housing; a front acoustic cavity is defined as a space between the front cover and the loudspeaker unit, and a rear acoustic cavity is defined as a space between the housing and the loudspeaker unit; the earphone is characterized in that, an acoustic guide channel capable of enhancing low-frequency performance of the earphone is disposed on one side of an inner sidewall of the housing closer to the loudspeaker unit, and the acoustic guide channel extends in a curved shape; the acoustic guide channel has an opening at one end and comprises an open end and a closed end, the open end is in communication with the rear acoustic cavity, and a bottom wall of the acoustic guide channel is provided with a plurality of through holes at a position closer to the closed end, the through holes are in communication with a sidewall of the housing, and an airflow in the acoustic guide channel is in communication with outside by means of the through holes.

2. The earphone of claim 1, characterized in that, the housing comprises an accommodating part for accommodating the loudspeaker unit, and a tubular extending part integrally extending from one end of the accommodating part; the rear acoustic cavity is defined as a space between the accommodating part and the speaker unit, and the acoustic guide channel is provided in the accommodating part; the audio signal wire is accommodated in the extending part.

3. The earphone of claim 2, characterized in that, the acoustic guide channel is composed of an acoustic guide groove and a cover coupled with the acoustic guide groove, the acoustic guide groove comprises two sidewalls extending in a same direction and a blocking wall positioned at ends of the two sidewalls, the cover is coupled to one side of the acoustic guide groove away from the sidewall of the housing; the through holes are provided at a bottom wall of the acoustic guide groove closer to the blocking wall.

4. The earphone of claim 3, characterized in that, the acoustic guide groove is integrally formed with the housing through injection molding, and is provided on the inner sidewall of the housing.

5. The earphone of claim 4, characterized in that, the cover is made of metal or plastic, and the cover is fixedly coupled with an open end of the acoustic guide groove by gumming or ultrasonic welding.

6. The earphone of claim 2, characterized in that, the acoustic guide channel comprises a groove-shaped acoustic guide groove formed independently, wherein one end of the acoustic guide groove closer to the inner sidewall of the housing is an open end, and the acoustic guide groove is fixedly coupled with the inner sidewall of the housing to define the acoustic guide channel.

7. The earphone of claim 6, characterized in that, the inner sidewall of the housing is provided with a concave mounting groove corresponding to the acoustic guide groove, and the mounting groove extends in a shape that is in accordance with a shape of the acoustic guide groove extends.

8. The earphone of claim 1, characterized in that, a damping sheet for covering the through holes is provided on the through holes; the damping sheet is combined to a bottom wall of the acoustic guide groove, and the damping sheet is made of mesh cloth, sponge or nonwoven fabric.

9. The earphone of claim 8, characterized in that, a portion of the bottom wall of the acoustic guide groove which is combined with the damping sheet has a thickness less than that of other portion of the bottom wall of the acoustic guide groove.

10. The earphone of claim 8, characterized in that, the housing is provided with a toning hole for communicating the rear acoustic cavity with outside, the position of the toning hole does not overlap with the position of the acoustic guide channel, a toning sheet for covering the toning hole is provided on the toning hole; the toning sheet is combined to an inner wall of the housing, and the toning sheet is made of mesh cloth, sponge or nonwoven fabric.

11. The earphone of claim 8, characterized in that, a length of the acoustic guide channel ranges from 1 mm to 100 mm, and an inner diameter of the acoustic guide channel ranges from 0.1 mm to 10 mm.

* * * * *